US005970905A

United States Patent [19]

Jaramillo, Sr.

[11] Patent Number: 5,970,905

[45] Date of Patent: Oct. 26, 1999

[54] AUTOMATICALLY RETRACTABLE TELESCOPIC AND ROTATABLE STEPS FOR WATERCRAFT

[76] Inventor: Alfonso Jaramillo, Sr., 20205 Lounsberry Rd., Lake Matthews, Calif. 92570

[21] Appl. No.: 09/227,484

[22] Filed: Jan. 7, 1999

[51] Int. Cl.[6] ..... B63H 11/02

[52] U.S. Cl. ..... 114/362; 182/89

[58] Field of Search ..... 114/362; 182/88, 182/89, 195; 296/62; 280/166

[56] References Cited

U.S. PATENT DOCUMENTS

| | | | |
|---|---|---|---|
| 2,678,832 | 5/1954 | Wright . | |
| 2,922,557 | 1/1960 | Jessen . | |
| 3,068,958 | 12/1962 | McCann . | |
| 3,584,704 | 6/1971 | Eckmann | 182/89 |
| 3,774,720 | 11/1973 | Hovey | 182/195 |
| 3,862,670 | 1/1975 | Hovey | 182/89 |
| 3,980,319 | 9/1976 | Kirkpatrick | 182/89 |
| 3,986,503 | 10/1976 | Le Guillon | 182/89 |
| 4,907,673 | 3/1990 | Ginter et al. | 114/362 |
| 4,926,965 | 5/1990 | Fox | 182/89 |
| 5,113,782 | 5/1992 | McCarty | 114/362 |
| 5,152,244 | 10/1992 | Jarmillo, Jr. et al. | 114/362 |
| 5,427,049 | 6/1995 | Mardikian | 114/362 |
| 5,458,080 | 10/1995 | Jaramillo, Sr. | 114/362 |
| 5,697,470 | 12/1997 | Carle | 182/88 |

*Primary Examiner*—Jesus D. Sotelo

*Attorney, Agent, or Firm*—Cislo & Thomas LLP; David L. Hoffman, Esq.

[57] ABSTRACT

A retractable ladder assembly for a watercraft has a rotatably mounted ladder which is attached to the craft by brackets. The ladder is pivotably mounted to the brackets. There is a plate biased to engage and rotatably retract the ladder from a use position to a storage position is also attached to the bracket. The bias is provided by a torsion spring. In one embodiment, the bracket mounts to the top of a rear platform of a boat and in another embodiment the ladder mounts to the underside of the rear platform of the boat. In both embodiments, the ladder may have a telescoping second ladder which retracts, due to gravity, when the torsion spring rotates the ladder assembly to a sufficient amount above the horizontal. There is also a stopper mechanism for each embodiment.

20 Claims, 9 Drawing Sheets

AUTOMATICALLY RETRACTABLE TELESCOPIC AND ROTATABLE STEPS FOR WATERCRAFT

BACKGROUND OF THE INVENTION

1. Field of the Invention

The present invention relates to a boat or watercraft step with an improved support and retracting mechanism, and in particular, to such a step having an enhanced spring pivot joint.

2. Description of the Related Art

In watercraft such as personal watercraft and boats, it is desirable to have an outboard step, which assists a user in boarding a personal watercraft or boat, e.g., from the water after falling off, swimming or water skiing. In U.S. Pat. No. 5,152,244, for which the present inventor was an inventor, a retractable stirrup having a U-shape is disclosed which pivotably mounts at its ends by means of two (2) brackets to the transom of a personal watercraft. A torsion spring has one end acting on the bracket and another end acting on the end of the U-shaped step. The joint is made by using a cylindrical sleeve fixedly mounted to the bracket and the spring is disposed over the sleeve. The end of the spring acting on the bracket is disposed in a slot formed in the sleeve. The end of the U-shaped member is pivotably connected to the sleeve by passing the sleeve through the tube.

In U.S. Pat. No. 5,458,080 to the present inventor, a retractable step assembly for a boat is disclosed. The assembly is formed by providing tubes disposed at the ends of a U-shaped retractable step, which tubes mate in a male-female fashion with tubes which are part of a mounting assembly. The tubes connected to the step are rotatable with respect to the tubes of the mounting assembly. Neither of the above U.S. patents provide a sufficiently strong spring, external to the ladder, to provide a sufficient retraction force for heavier ladders and storage space for heavier ladders.

It has also been proposed to provide additional space for a spring by modifying the step of U.S. Pat. No. 5,458,080. However, these springs do not retract ladders axially in case of extendable ladders and do not retract ladders through an arc where the ladder is translatable with respect to the spring.

There is a need to retract ladders through an arc but where the ladder has a separate pivot point from the spring and where the ladder is translatable with respect to the spring. In addition, in certain ladders mounted on the top of the boat, there is a need to control rotation of the ladder to its storage position to avoid injuring people during retraction of the ladder. Further, where such ladders have telescoping ladder assemblies, there is a need to retract in two ways, i.e., rotationally and axially, yet avoid a complex, expensive and cumbersome structure.

SUMMARY OF THE INVENTION

In one embodiment, the invention provides a ladder element including a base U-shaped member having a rung and two parallel tubes. At one end of each tube remote from the rung there is a pivot pin or the like. The pin is fixed to a bracket or translatable with respect to the bracket and engages notches in the bracket. The bracket includes a spring mounted plate separate from the ladder element and preferably having a separate pivot point from the ladder element. The plate provides a mechanism for pivotally engaging the base of the ladder and the bracket has a torsion spring mounted thereon. One end of the spring is fixed to or adjacent, and acts on, the bracket and the other end acts on the plate, which provides a rotation translation member. The spring urges the plate to rotate, and the plate engages the tubes of the ladder which in turn urges the ladder to rotate about its pivot pins.

In a preferred embodiment, additional ladder elements which telescope from the base element may be provided. For example, a second U-shaped member having a rung and tubes which slidably engage within the tubes of the base member may be provided. In such an embodiment, when the spring force rotates the ladder to a sufficient angle beyond horizontal, the additional ladder elements retract due to gravity axially within the base member.

In an embodiment where the ladder is mounted to the underside of a boat's rear platform, the ladder is translatable and retractable with respect to the bracket and is supported by the bracket. There is a stopper mechanism, preferably formed by tabs in the plate which engage notches in the bracket walls when the ladder has been retracted to a sufficient angle. In an embodiment where the ladder is mounted to the top of the rear platform of a boat, there is a safety stopper mechanism incorporated within the ladder.

DETAILED DESCRIPTION OF THE PREFERRED EMBODIMENT(S)

Figure 1:
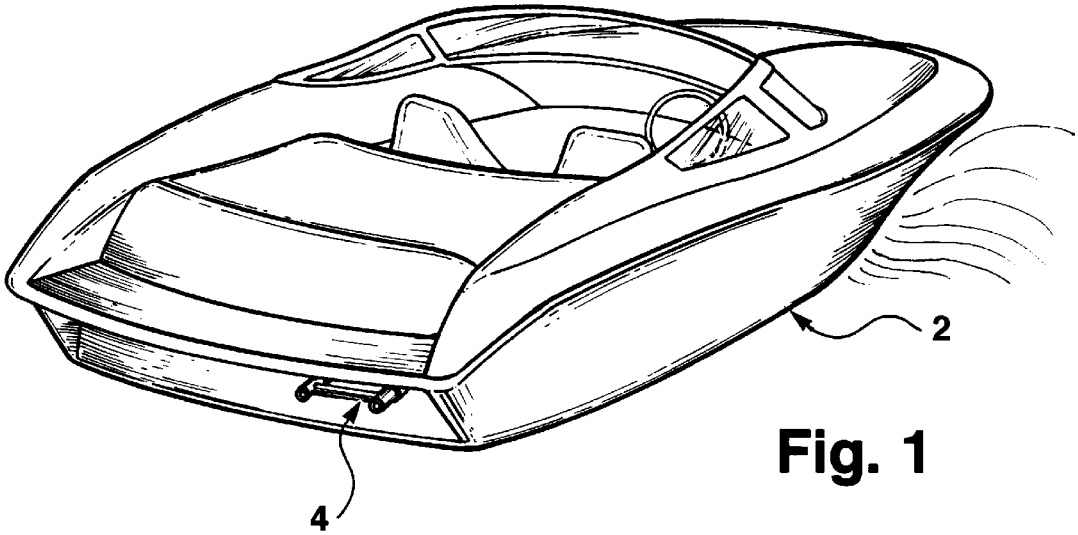
FIG. 1 is a view of a ladder assembly in accordance with a first embodiment of the invention mounted to the underside of a boat.
Figure 2:
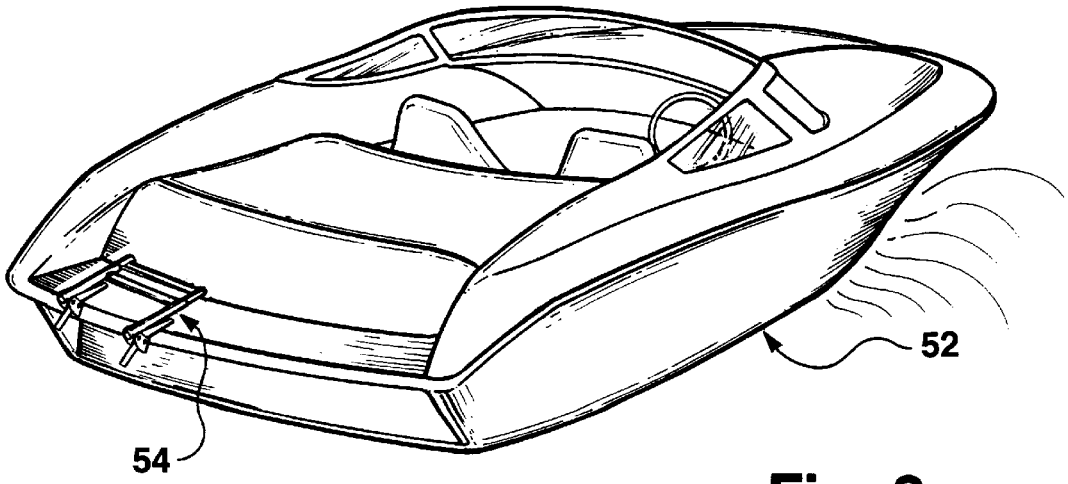
FIG. 2 is a perspective view of a ladder in accordance with another embodiment of the invention mounted to the top of a rear platform of a boat.

In FIG. 1, a ladder assembly 4 in accordance with the invention is mounted to the underside of a rear platform of a boat 2. The ladder assembly includes a ladder 9, which is shown in a retracted position in FIG. 3. Ladder 9 is mounted by two bracket members 8 to the underside 12 of the boat's stern platform. Each bracket assembly 8 includes two flanges 14 fixed by bolts 16 to the boat. The flanges are connected to bracket sidewalls 18 which are further connected by a rear bracket wall 20.

The ladder 9 includes a first or base ladder having two parallel tubes 22 joined by a cross member or rung 24. The invention may be embodied in a single rung ladder, but also may be embodied as shown with a telescoping second ladder member having two parallel tubes 25 which telescope within the base tubes 22, and a rung 26 connecting the two telescoping tubes 25. Such a structure is well known in the art.

Figure 5:
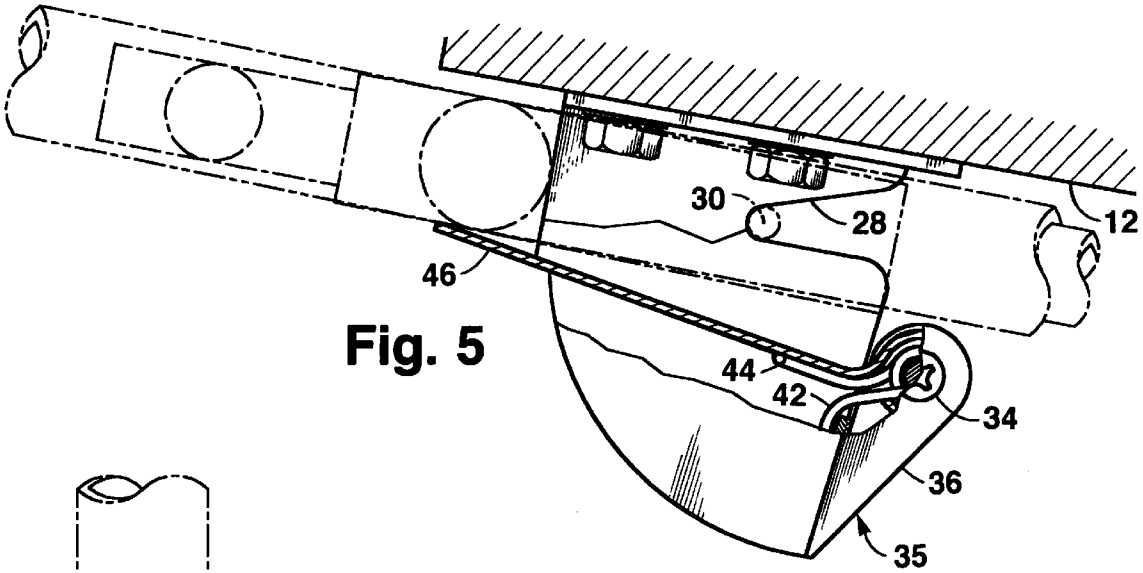
FIG. 5 is a partial side and partial sectional view showing the ladder assembly of FIGS. 3 and 4.
Figure 6:
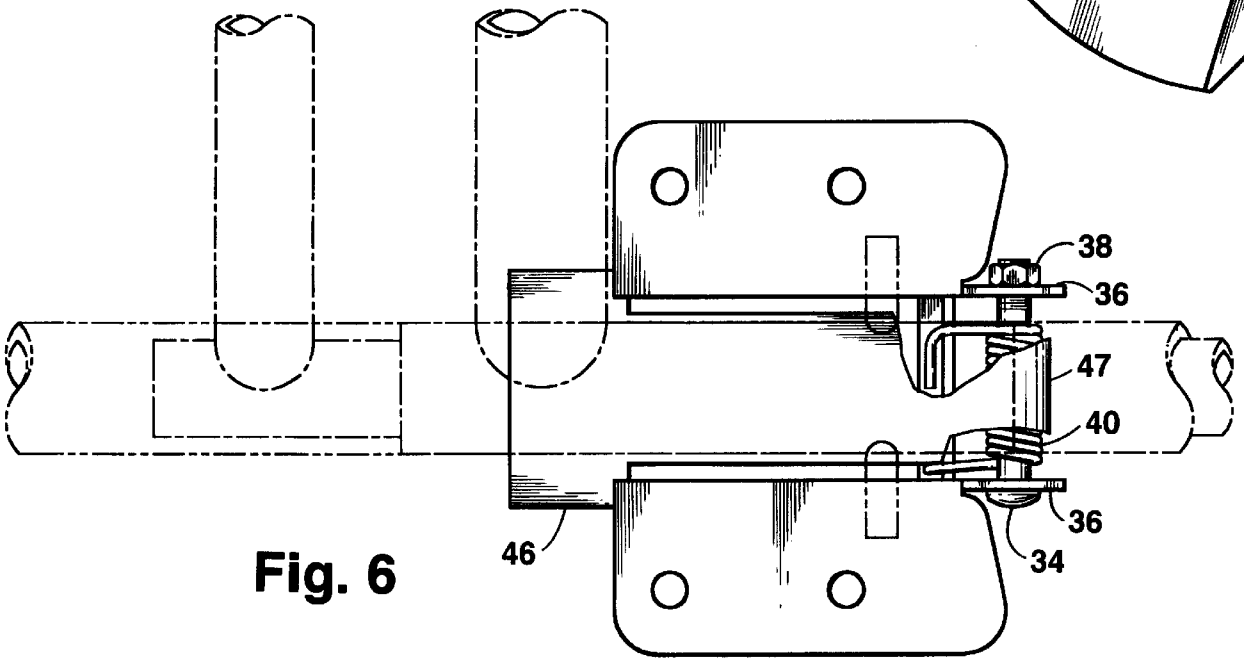
FIG. 6 is a top view of a portion of the ladder assembly of FIGS. 3 and 4.

As shown in FIGS. 5 and 6, each bracket assembly further includes a spring biased assembly 35 biasing the ladder to its storage position. This assembly includes a pin or bolt 34 passing through two sides 36 which are fixed to or unitary with the rest of the bracket member. A nut 38 fixes pin 34. A torsion spring 40 mounted around pin 34 has one end 42 fixed to or adjacent, and acting on the bracket, e.g., at the rear wall 20, and a second end 44 fixed to or adjacent, and acting on a rotatably mounted plate 46. The plate 46 serves as a support for the ladder and a rotational force transfer mechanism to transfer the bias of the torsion spring 40 to the tubes of the base ladder. The plate 46 has a curved end 47 which is wrapped around the spring 40 to provide a pivot axis.

Figure 3:
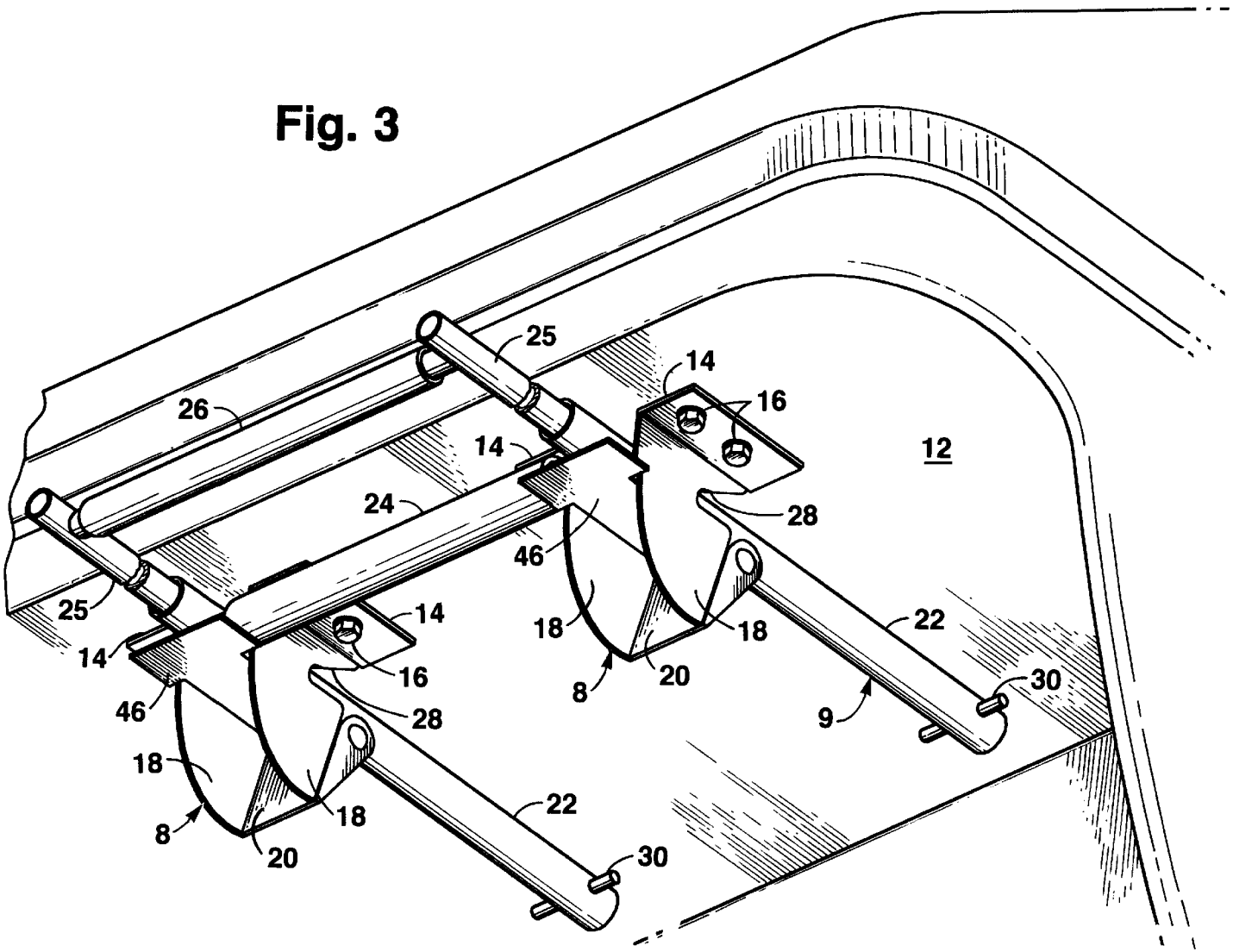
FIG. 3 is a perspective and enlarged view of the ladder assembly of the first embodiment in a storage position and its connection to the underside of the boat of FIG. 1.
Figure 4:
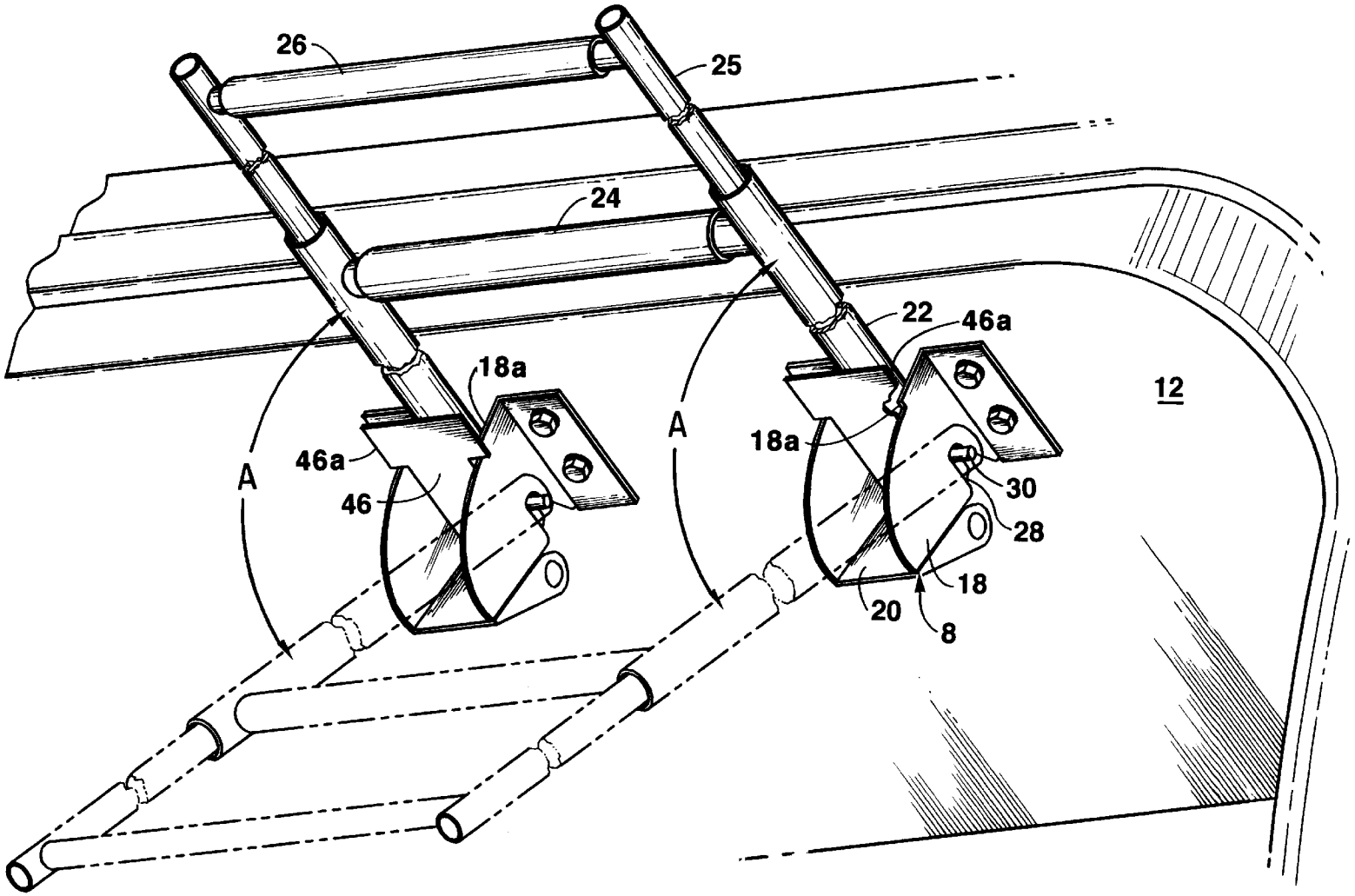
FIG. 4 is a view similar to FIG. 3 showing the ladder in an extended and intermediate position in solid lines and in an in-use position in phantom.

With reference to FIGS. 3 and 4, operation of the first embodiment will now be described. In the retracted (storage) position as shown in FIG. 3, the ladder is at an angle, e.g., a shallow angle of approximately six to ten degrees. It is held up by the plate 46. While there may be some play, generally this is not of concern. If it is, additional support could be provided such as a strap connected to the stern of the boat, or a spring-clip catch fastened to the stern, or other structure as would be evident to one of ordinary skill in the art.

In the retracted position, the rung 24 of the base ladder contacts the front edges of the sides 18 of the bracket member which also holds the ladder.

To use the ladder, a person on the boat leans over the stern and pulls the ladder outward. If it is a two-rung ladder, this person pulls out at least the base rung and may pull out both rungs. This same procedure may be followed by someone in the water who wants to get onto the boat. The ladder will then be in the solid position, an intermediate position, shown in FIG. 4. The person in the water or on the boat then presses down on the ladder or pulls it down rotating it through angle A against the bias of the torsion spring 40 until the tubes 22 contact the back 20 of the bracket or a stopper. The user may then step on the ladder to enter or exit the boat. The ladder is in the position ("use position") shown in phantom in FIG. 4.

The pivot point of the ladder is formed by a rod or pin 30 located proximate the free end of the tubes 22. In the rear of the sides 18 of the bracket, there is a notch 28. This notch 28 slidably receives the pin or rod 30 and provides a pivot point for the ladder. The bracket 8 and plate 46 provide slidable support for the ladder and the notch 28 and pin 30 provide an engageable and disengageable pivot point so that the ladder may be moved laterally in and out of the notch.

To return from the use position shown in phantom in FIG. 4, the user steps off of the ladder and the spring 40 urges plate 46 to rotate clockwise in FIG. 4 which moves the ladder to the solid intermediate ("rotationally retracted") position of FIG. 4. In this position, the ladder is above the horizontal, preferably by a sufficient amount such that gravity will retract tubes 25 into the base tubes 22 and gravity will retract the tubes 22 as well so the ladder automatically moves to the retracted, storage position. It is noted that plate 46 has two tabs 46*a* which meet a notch 18*a* in each sidewall 18 which acts as a stopper to rotational retraction (see FIG. 4).

Figure 11:
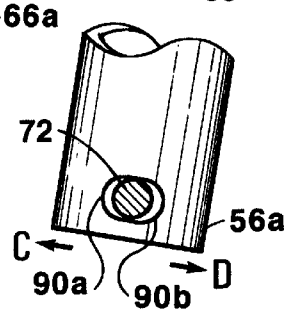
FIG. 11 is a view of a portion of the ladder of FIG. 10 for purposes of explaining the spring in FIG. 10.

With reference to FIGS. 2 and 7–12, a second embodiment of the invention where a ladder assembly 54 is attached to the top side of the stern of a boat 52 is shown. Bracket 60 has a boat mounting element 64 with a flange 66 which is connected by bolts 68 to the stern platform 13. The mounting element 64 has side flanges 70 having a pin 72 extending therethrough. The pin forms a pivot for a base ladder element formed by parallel tubes 56 and a rung 58. Specifically, the pivot pin 72 passes through the tubes 56 proximate their ends by means of an elongated aperture 90 as best shown in FIG. 11. As in the previous embodiment, a second, telescoping ladder element may be provided. This ladder is shown with parallel tubes 59 that telescope within the tubes 56, and a rung 61 connecting the tubes 59. In both embodiments, the rungs may be provided with an anti-slip material and the rest of the assembly may be aluminum or stainless steel.

Figure 12:
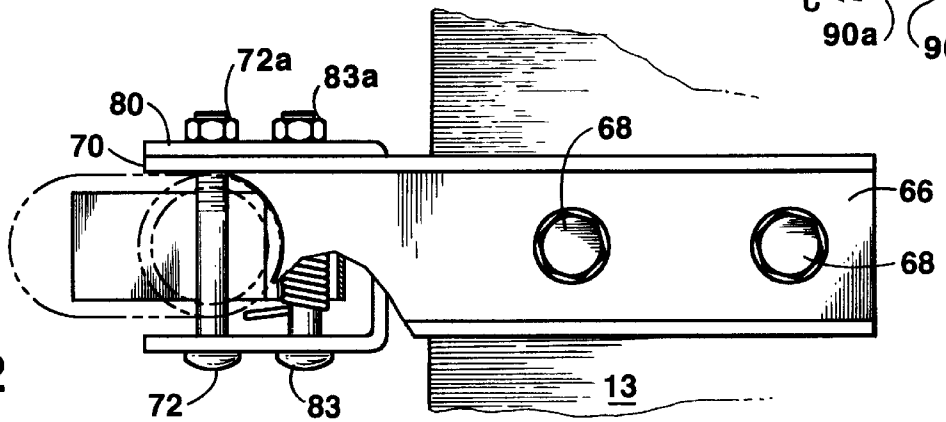
FIG. 12 is a top view showing the connection of the ladder assembly to the top of the rear of the boat and certain details of the ladder assembly.

The bracket 60 includes a biasing element having a rear wall 78 and sides 80 connected thereto. The pin 72 also passes through the sides 80, which are fixed to the sides 70 of the mounting element 64. Sides 70 and 80 may be welded together as shown in FIG. 12. Another pin 83 is connected between the sides 80 of the spring bias assembly and has a torsion spring 84 wrapped around it. One end 84*a* of the spring is fixed to or adjacent and acts on the bracket 60, e.g., at rear wall 78 and the other end 84*b* of the spring is adjacent to or fixed to, and acts on the a plate 82. The plate 82 serves to transmit the torsion from the spring to the tubes 56. One end 82*a* of the plate is wrapped around the spring to pivot about the pin 83.

Figure 7:
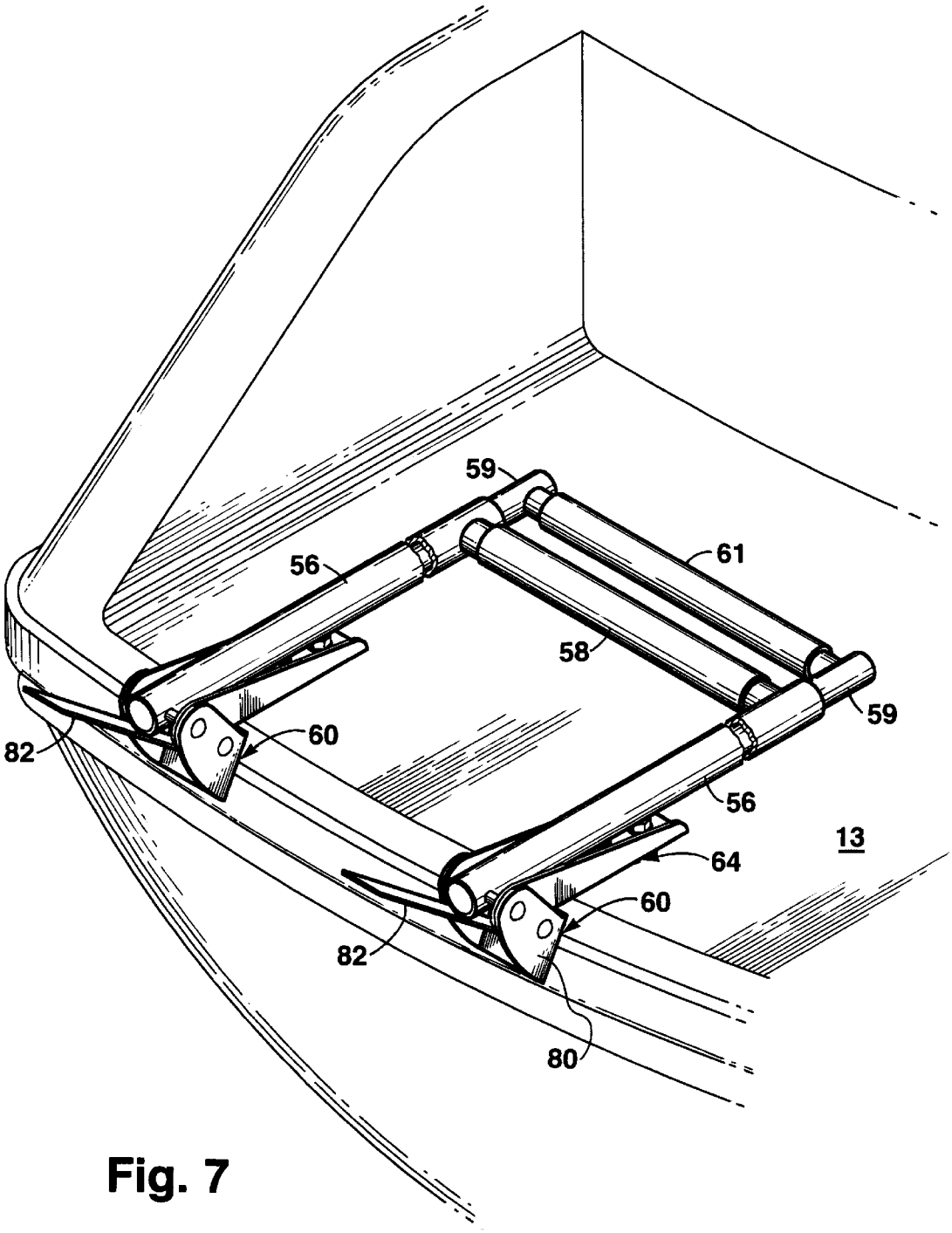
FIG. 7 is a perspective and enlarged view of the ladder assembly of FIG. 2 in a storage position and its connection to the boat.
Figure 8:
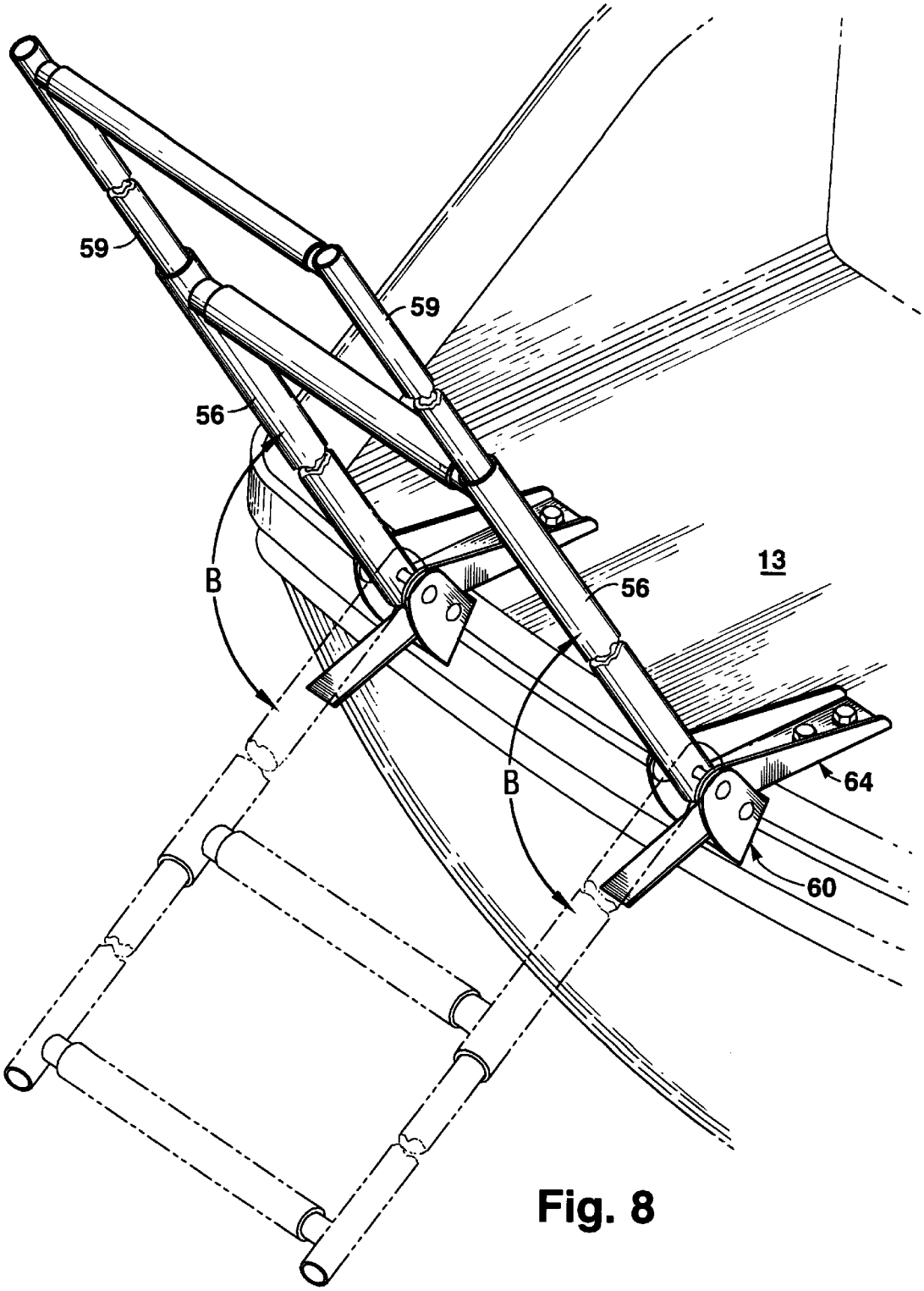
FIG. 8 is a view similar to FIG. 7 showing the ladder in an extended and intermediate position in solid lines and an in-use position in phantom.
Figure 10:
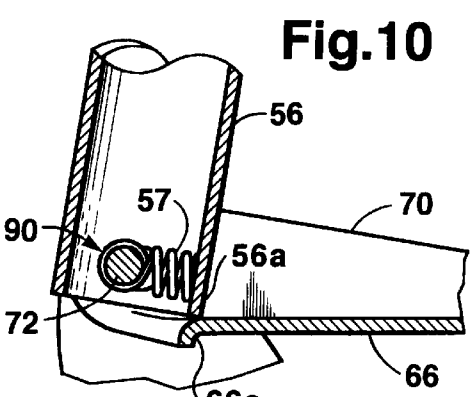
FIG. 10 is an enlarged sectional view of the bottom of the ladder and its connection to a bracket showing an internal spring in the ladder.
Figure 9:
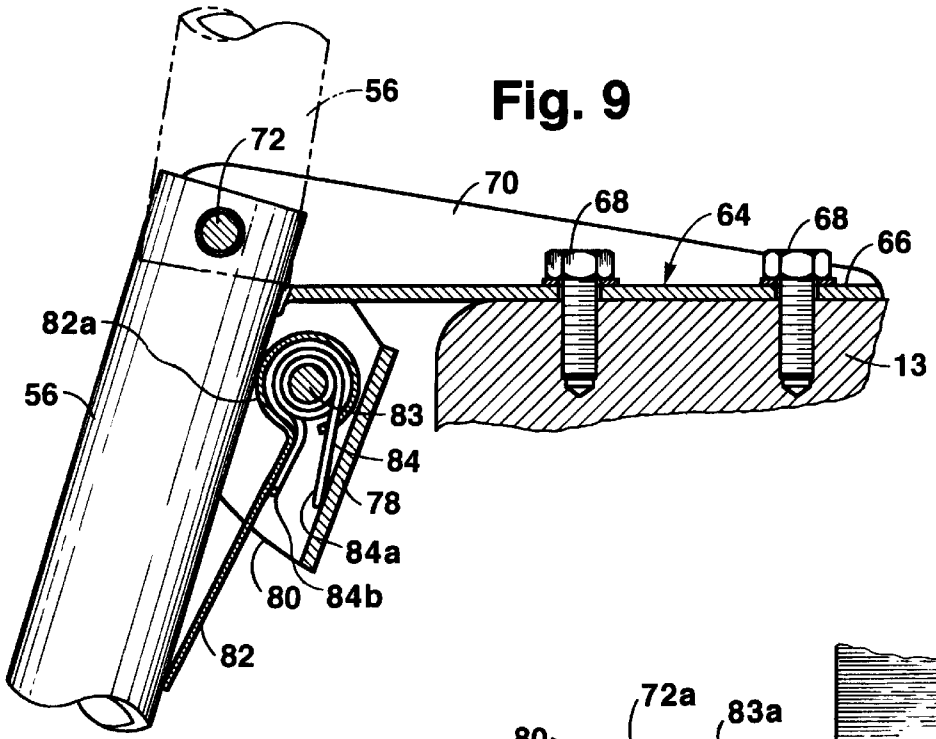
FIG. 9 is a partial sectional view of the ladder assembly and its connection to the boat.

The ladder described above operates as follows. FIG. 7 shows the storage position of the ladder. A user pulls the ladder up to an intermediate position as shown in FIGS. 8 and 9 (in solid in FIG. 8 and phantom in FIG. 9). In the intermediate position of FIG. 8, or prior to reaching that position, the ladder is at an angle above the horizontal and the tubes 59 of the telescoping ladder will automatically retract by means of gravity into the tubes 56 of the base ladder.

There is an intermediate stopper mechanism (described below) which is overcome by the user continuing to push on the ladder or pull down so that the ladder rotates about arc B (FIG. 8) to the use position shown in phantom therein. After use, the spring bias on the plate 82 is transmitted to the ladder by the tubes 56 so that the ladder rotates back through arc B to the intermediate position shown in solid in FIG. 8 and phantom in FIG. 9, and also in FIG. 10. The stopper mechanism, while optional, serves to hold the ladder in this intermediate position so that the ladder does not snap back against a person standing near it during rotational retraction.

The ladder is held in the intermediate position by its bottom 56*a* contacting the end 66*a* of the flange 66. The bottom 56*a* of the ladder is biased to this position by means of a compression spring 57 which acts on the inside of the ladder pushing it to the right in FIG. 10 and which is also connected to the fixed pivot pin 72. This tends to move the ladder to the right in the direction of arrow D of FIG. 11 so that the bottom 56*a* of the ladder is sufficiently far to the right to contact the end 66*a* of the flange and the pin 72 contacts the left side 90*a* of the slot. When a user continues to pull on the ladder, by means of lever action the bottom end 56*a* of the ladder compresses the spring 57 moving the ladder to the left and in the direction of arrow C such that the pin 72 contacts the right side 90*b* of the slot 90 and the bottom 56*a* clears the end 66*a* of the flange.

The pins 72 and 83 may be attached by means of nuts 72*a* and 83*a* as shown in FIG. 12.

Figure 13:
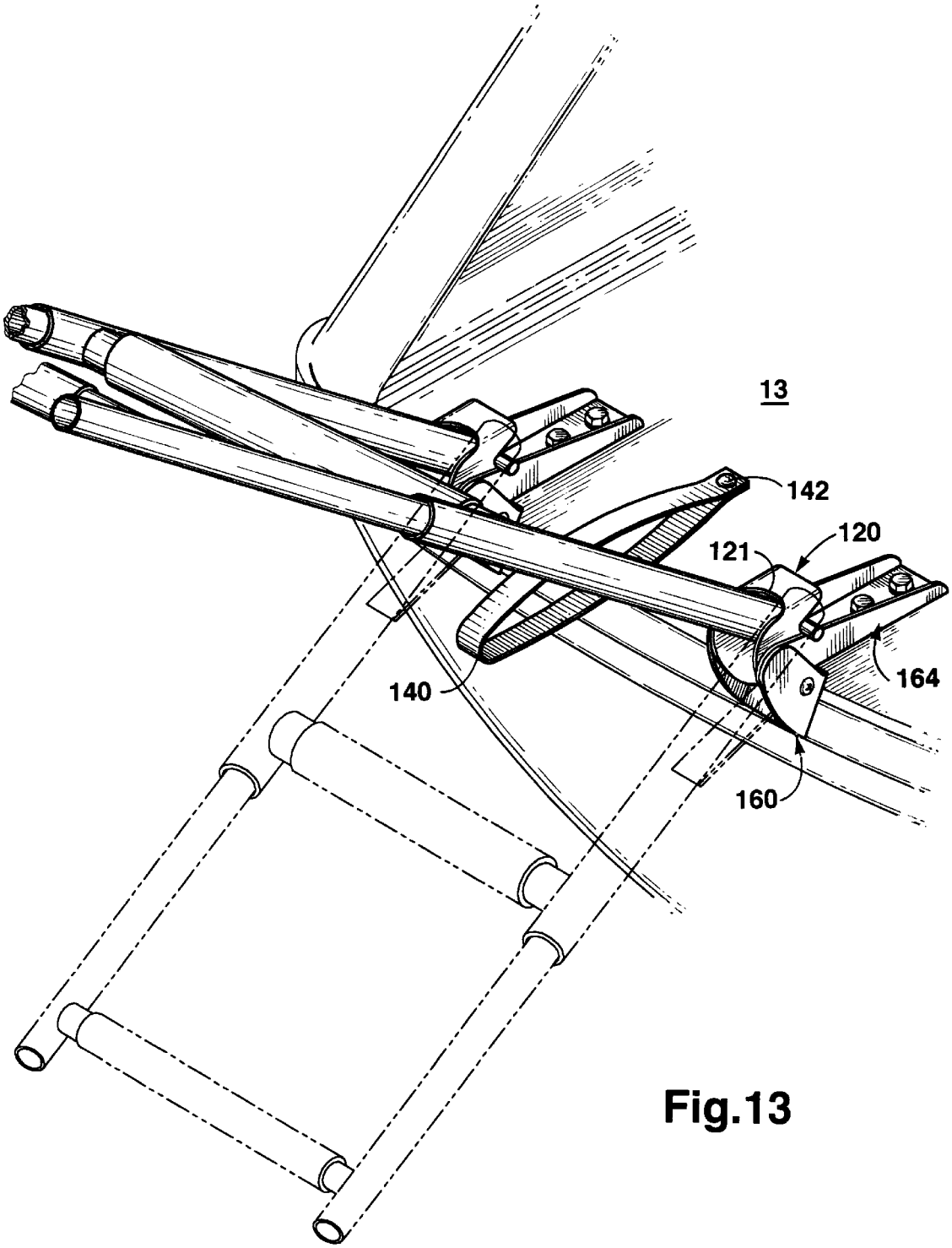
FIG. 13 is a view similar to that of FIG. 8 but showing a variation of the embodiment of FIG. 2 showing a difference in a bracket for mounting the ladder and a strap for holding the ladder.
Figure 14:
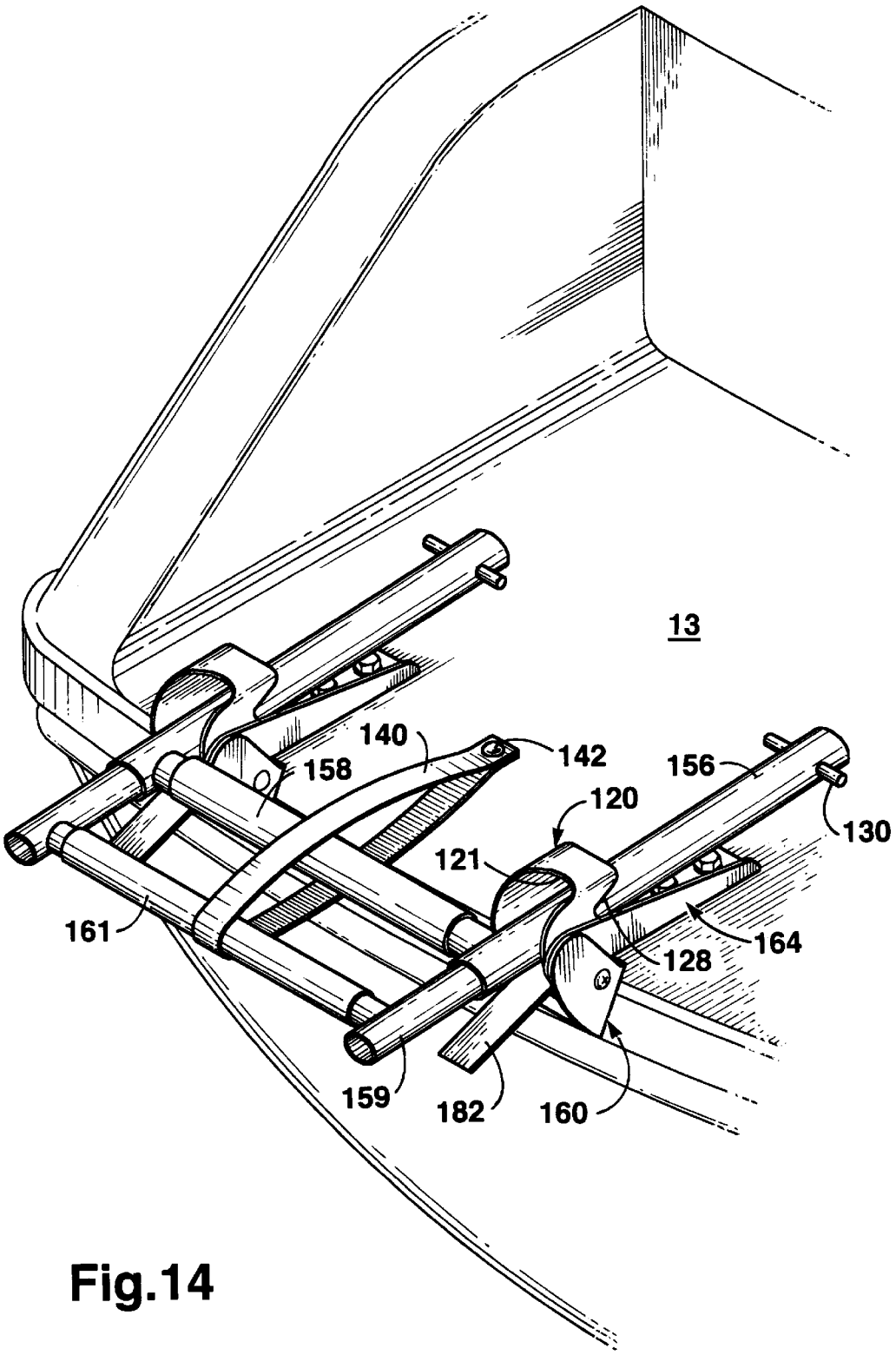
FIG. 14 is an enlarged view of the ladder in FIG. 13 in a retracted position.

FIGS. 13 and 14 show a variation of the second embodiment of the invention. In this variation, the ladder is mounted to the top of the stern platform 13 of a boat by means of a bracket 160 and a boat mounting element 64 which are the same as in the embodiment of FIGS. 2 and 7–12, except as described below. The bracket 160 has a ladder receiving element 120 fixed to the bracket's sidewalls, e.g., by welding. The member 120 has a notch 128 for receiving a pin 130 fixed proximate a free end of first tubes 156 of a ladder, which is identical or substantially identical to the ladder of the first embodiment.

The bracket 160 does not have a pin or bolt for supporting the end of the ladder. Rather, as in the first embodiment, the ladder has the pivot pin 130 which is received within a notch 128 in the member 120. The notch 128 and pin 130 may be identical to the notch 28 and pin 30 in the first embodiment. In this embodiment, a front edge 121 of the member 120 acts as a stopper for the rotatable retraction of the ladder. Therefore, in this embodiment the ladder does not need the internal compression spring mechanism of the second embodiment. There is also a ladder holding or strapping mechanism formed, e.g., by a strap 140, preferably of rubber, and a pin 142 attaching one end of the strap to the stern 13 and also serving as an anchor to position the other end of the strap.

In use in this embodiment, the user undoes the strapping mechanism and pulls or pushes the ladder until the pin 130 is in the notch 128. The user then pulls down the ladder from the solid position of FIG. 13, to the in-use position shown in phantom. After use, the ladder automatically rotationally retracts to the solid, intermediate and rotationally retracted position of FIG. 13 by means of the spring-bias mechanism acting on a plate 182 serving to transmit the torsion from a spring to the ladder's tubes 156, as in the previous embodiments. In the intermediate position, the ladder is above horizontal, and if there is a telescoping ladder, as is shown in the drawings, its tubes 159 will retract into the first tubes with its rung 161 serving as a stopper for this retraction. The first rung 158 serves as a stopper for translational retraction of the ladder, as in the first embodiment. If necessary, the user may assist in the translational retraction. In addition, if necessary to avoid movement of the ladder in the storage position, the user may engage the rubber strap 140. In place of the rubber strap, a spring clip or the like may be used.

While the present invention has been described with regards to particular embodiments, it is recognized that additional variations of the present invention may be devised without departing from the inventive concept.

What is claimed is:

1. A step assembly for watercraft, comprising:

a U-shaped base step having two elongate sides and a rung extending therebetween, the sides each having an end remote from the rung; and two mounting elements for pivotably supporting the base step proximate each of the ends of the sides, each mounting element comprising means for fixing the element to a watercraft for providing a pivot axis for enabling rotating of the base between a first position where the base step extends substantially downward for use by a person trying to embark on or disembark from the watercraft, and a second position where the step is rotationally retracted with respect to the first position, and means for biasing the base step to rotationally retract by rotating from the first position to the second position, the means for biasing including a force transfer member for nonintegrally contacting each side at a location spaced from the pivot axis to transfer force from the means for biasing to the step such that the step pivots from the first position to the second position, wherein the force transfer member is rotatably mounted about an axis distinct from the pivot axis.

2. The step assembly of claim 1, wherein the means for biasing further comprises a torsion spring.

3. The step assembly of claim 1, wherein the mounting elements each further comprise a stopper for stopping the force transfer member when the base step is at the first position.

4. The step assembly of claim 1, wherein the force transfer member comprises a plate rotatably mounted about an axis distinct from the pivot axis.

5. The step assembly of claim 1, wherein the force transfer member comprises an elongated member.

6. The step assembly of claim 1, wherein each mounting element comprises a pair of parallel flanges each having a notch therein, and the first tubes each have a pin fixed thereto proximate their free ends and extending transverse thereto, for seating in each said notch, for enabling rotation with respect to said mounting element at said pivot axis.

7. The step assembly of claim 1, wherein the mounting elements further support the base step such that the sides are slidable in an axial direction with respect thereto.

8. The step assembly of claim 1, further comprising an intermediate stopper mechanism for stopping rotational retraction of the step intermediate the first and second positions.

9. The step assembly of claim 8, wherein the intermediate stopper mechanism comprises a compression spring disposed inside the sides proximate the end remote from the rung and acting on each side and the pivot axis to bias the sides into an interference position, the sides having an aperture through which the pivot axis passes which extends in the first direction, and the mounting elements having a flange for mounting to a boat, wherein in the interference position, the free ends of the sides contact the flange thereby limiting rotation of the sides, and wherein the spring is compressed such that the free ends of the sides are in a non-interfering position in response to manually rotating the sides from the intermediate position toward the second position such that the free ends rotate clear of the flange.

10. The step assembly of claim 1, wherein the base step is movable with respect to the means of biasing.

11. The step assembly of claim 1, wherein in the first position the base step is beyond horizontal and moves laterally under gravity with respect to the mounting element.

12. The step assembly of claim 1, further comprising an extension step having sides retractable with respect to the sides of the base step, and wherein in the second position the base step is beyond horizontal such that the sides of the extension step retract under gravity with respect to the sides of the base step.

13. A step assembly for a watercraft, comprising:

a U-shaped base step having two elongate sides and a rung extending therebetween, the sides each having an end remote from the rung; and two mounting elements for pivotably supporting the base step proximate each of the ends of the sides, each mounting element comprising means for fixing the element to a watercraft for enabling rotation of the base step between a first position where the base step extends substantially downward for use by a person trying to embark on or disembark from the watercraft, and a second position where the step is rotationally retracted with respect to the first position, and means for biasing the base step to rotationally retract by rotating from the first position to the second position, the means for biasing including a force transfer member for contacting each side at a location spaced from the pivot axis to transfer force from the means for biasing to the step such that the step pivots from the first position to the second position, and wherein the step is moveable with respect to the means for biasing, wherein the force transfer member is rotatable mounted about an axis distinct from the pivot axis.

14. The step assembly of claim 13, wherein the mounting elements each further comprise a stopper for stopping the first transfer member when the base step is at the second position.

15. The step assembly of claim 13, wherein the means for biasing comprises a torsion spring.

16. The step assembly of claim 13, wherein each mounting element comprises a pair of parallel flanges each having a notch therein, and the first tubes each have a pin fixed thereto and extending parallel thereto, for seating in each said notch, for rotation with respect to said mounting element.

17. The step assembly of claim 13, wherein the force transfer member comprises a plate.

18. The step assembly of claim 13, wherein the mounting elements further support the base step such that the sides are slidable in an axial direction thereof with respect to the mounting elements.

19. The step assembly of claim 13, further comprising a stopper mechanism for stopping rotational retraction of the force transfer member.

20. A step assembly for a watercraft, comprising:

a U-shaped base member having two first tubular members with a rung extending therebetween and with two ends remote from the rung;

a U-shaped extension member having two second tubular members for being slidably supported by and with respect to the two first tubular members between an axially extended position with respect to the first tubular members for use and an axially retracted position with respect to the first tubular members for storage, and having a rung extending between the second tubular members; and two mounting elements for pivotably supporting the base member proximate each of the ends of the first tubular members, each mounting element comprising means for fixing the element to a watercraft for pivoting the base member and extension member from a first position where the base member and extension member extend downward for use by a person trying to embark or disembark from the watercraft, and a second position where the base member and extension member are stored, and means for biasing the base member to rotate from the first position to the second position, wherein the second position is such that the base member and extension member are at least at an acute angle above horizontal sufficient such that the second tubular members of the extension member will axially retract with respect to the first tubular members of the base member under gravity.

* * * * *